United States Patent [19]

Sharp

[11] 4,245,572

[45] Jan. 20, 1981

[54] FURNACE COOLING SYSTEM

[76] Inventor: Kenneth C. Sharp, 30 Mountcombe Close, Upper Brighton Hill, Surbiton, Surrey, England

[21] Appl. No.: 35,492

[22] Filed: May 30, 1979

[51] Int. Cl.[3] ..... F27D 1/12

[52] U.S. Cl. ..... 110/336; 122/6 B; 266/193; 432/238

[58] Field of Search ..... 110/336; 122/6 R, 6 A, 122/6 B, 366; 432/238; 13/32; 266/193, 194

[56] References Cited

U.S. PATENT DOCUMENTS

| | | | |
|---|---|---|---|
| 628,790 | 7/1899 | Gaines et al. | 122/6 B X |
| 3,679,194 | 7/1972 | Jones et al. | 432/238 |
| 4,169,387 | 10/1979 | Krempl | 73/708 |

FOREIGN PATENT DOCUMENTS

| | | | |
|---|---|---|---|
| 499300 | 4/1976 | U.S.S.R. | 266/193 |

*Primary Examiner*—Charles A. Ruehl
*Attorney, Agent, or Firm*—McWilliams, Mann & Zummer

[57] ABSTRACT

A furnace cooling wall construction including a cooling plate built into the wall disposed transversely with one or more heat pipes enclosed in the plate and extending between a cooling chamber in the plate and adjacent the inner end of the plate with cooling water circulated to the chamber for circulation by the heat pipe.

4 Claims, 5 Drawing Figures

FURNACE COOLING SYSTEM

BACKGROUND OF THE INVENTION

One of the major inconveniences and sources of expense in the operation of a shaft furnace is the need to replace the refractory lining of the furnace at intervals. By cooling the refractory lining it can be made to last longer, but the replacement of the cooling means increases the complexity and expense of the re-lining operation. One method of cooling shaft furnaces known as plate cooling has been known for many years and has generally found favour. This method involves the provision of water-cooled plates in the refractory lining of the furnaces, which plates extend transversely with respect to the working surface of the lining. These plates are usually built into the furnace walls as the furnaces lining is built up. This type of cooling is particularly suitable for the bosh zone of the furnace although it can be used in other zones. It is usual for about seven to nine cooling plates to be interconnected by intermediate water inlet and outlets so that a single main water inlet and a single main water outlet only need be provided for this series of plates. This type of cooling is very efficient whilst it is operative normally since the cooled face of the plate is close to the inner face of the lining of the furnace. However, when leakage occurs, and in mid to late campaigns this is frequent, then serious water ingress can occur.

OBJECTS OF THE INVENTION

It is an object of the present invention to provide an improved cooling system for a shaft furnace. The system relies on the use of heat pipes.

A heat pipe is a relatively simple structure that transmits thermal energy very efficiently, it is a sealed enclosure containing a fluid material and a wick. One end of the pipe is situated adjacent a heat source and the other end adjacent a heat sink. The fluid is so chosen as to be liquid at the sink temperature and in the vapour phase at the heat source temperature. The vapour diffuses from the hot end by the capillary action of the wick. Heat pipes are most often cylindrical in shape, but can be made in other forms, for example a laminar shape.

DESCRIPTION OF PREFERRED EMBODIMENT

Embodiments of the invention will now be described, by way of example only, with reference to the accompanying drawings.

Figure 1:
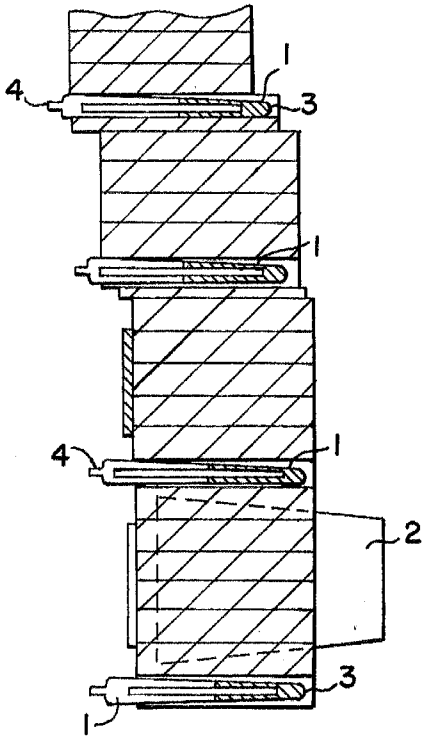
FIG. 1 is a view of a vertical section through part of the wall of a blast furnace.

In FIG. 1 the part of the furnace shown is the lower bosh zone and the zone around a tuyere 2. The walls of the blast furnace are built up in layers and cooling plates 1 are interposed with these layers at intervals.

The cooling plates are tapered towards their inner-facing edges 3 and are partially hollow. The interiors of the cooling plates 1 receive a flow of cooling water via inlets 4 at their rearwardly-facing edges.

Figure 3:
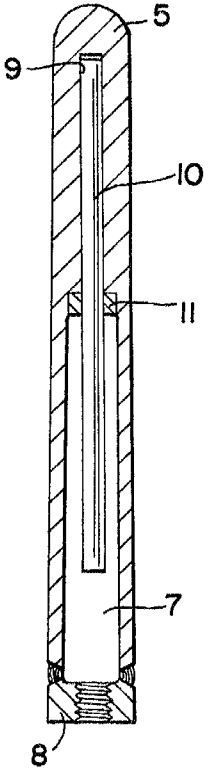
FIG. 3 is a vertical section along the line X—X of the cooling plate of FIG. 2.
Figure 2:
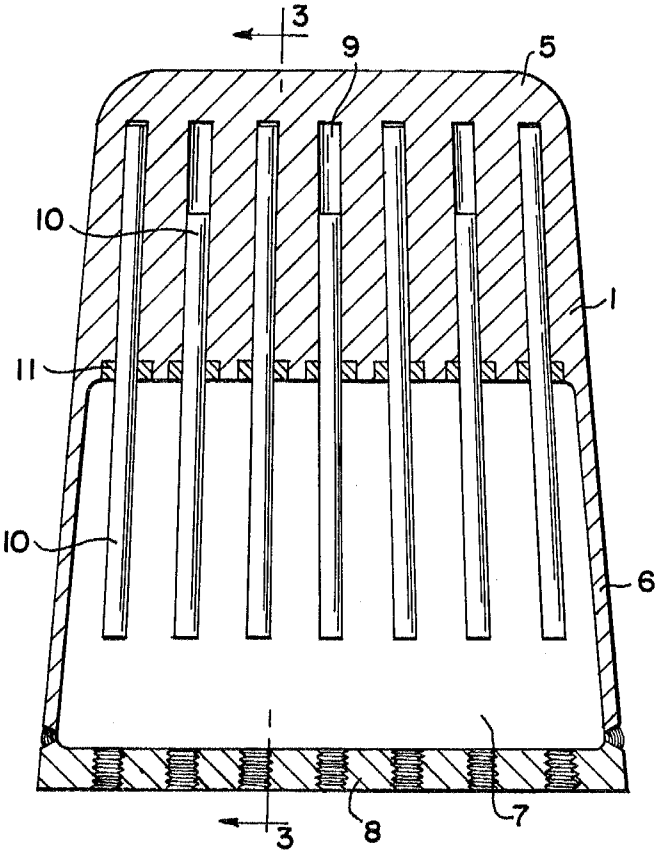
FIG. 2 is a horizontal section through a cooling plate.

Referring to FIGS. 2 and 3, each plate 1 located in the walls of the furnace is a generally flat structure having a first portion 5 which is solid and is the end of the plate which is located closer to the interior of the furnace. An enclosure-defining wall 6 extends from the circumference of the rearwardly facing surface of the portion 5 and defines a chamber 7 for the cooling fluid. A back plate 8 is welded onto the wall 6 to complete the enclosure of the cooling chamber 7. The back plate includes inlet and outlet apertures connecting with the cooling chambers of other cooling plates. The solid portion 5 of the plate includes a number of bores 9 extending from its rearward surface towards its front edge 3. These bores terminate before the front edge 3 of the solid portion 5 and are so dimensioned to receive cylindrical heat pipes 10 so that when located in the bores 9 the heat pipes 10 extend to a considerable extent out from the portion 5 into the cooling chamber 7. Sealing rings 11 are provided at the openings of the bores 9 on the rearward facing surface of the portion 5 so that a water tight seal is maintained around heat pipes 10 when located in the bores. The heat pipes can be moved towards and away from the inner-facing edge 3 of the plate by moving them within the bores 9 so that some heat pipes may be positioned further from the hottest surface so that they remain operative even when the hot ends of the fully inserted heat pipe have been worn back.

MODIFIED EMBODIMENT

Figure 4:
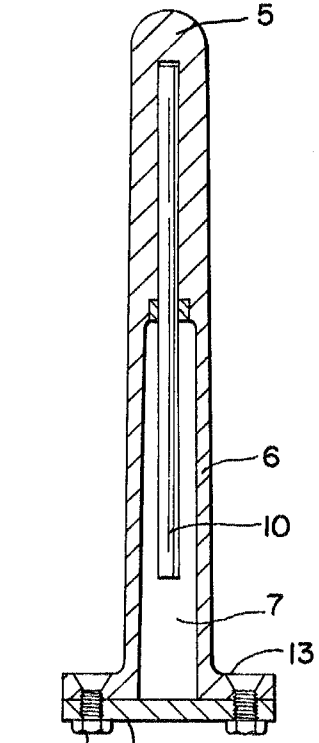
FIG. 4 is a horizontal section through an alternative cooling plate.
Figure 5:
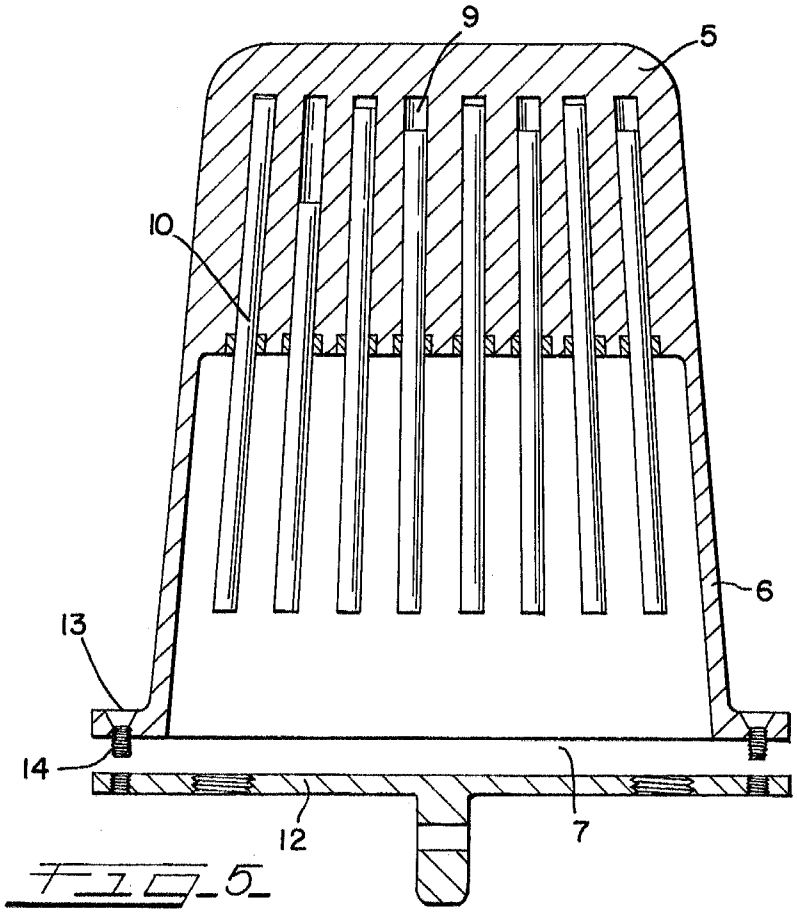
FIG. 5 is a vertical section along the line X–Y of the cooling plate of FIG. 4.

Referring to FIGS. 4 and 5, in an alternative arrangement the cooling plate may include a removable back plate 12 connected to a flange 13 extending from the enclosure wall 6. The connection may be by means of bolts 14, allowing the back plate 12 to be removed so that the heat pipes may be removed or their positions in the bores altered.

Each plate in the system may be fabricated from copper, or alternatively it may be cast in alloy steel, refractory or a combination of metal and high conductivity refractory. The heat pipes may be curved to suit the contour of the cooling plates and may be partly cast in the solid portions 5 of the cooling plates.

What is claimed is:

1. In a furnace wall construction having at least one cooling plate built into the wall, said plate being disposed transversely in the wall, at least one heat pipe enclosed in said plate extending toward the interior of the furnace, the wall of the furnace being built up in layers and said cooling plate disposed at intervals between the layers, said cooling plate being tapered toward its edge facing the interior of the furnace, said plate being at least partially hollow, an inlet adjacent the rearwardly facing edge of the plate to receive a flow of cooling water into said hollow, said rearwardly facing edge comprising a back plate welded to the plate to enclose the hollow and form a cooling chamber through which the cooling water is circulated, said back plate including an inlet and an outlet for the circulation of said cooling water connected with cooling chambers of other plates, said cooling plate including a solid portion extending from said interior edge to said hollow and having a plurality of bores extending from adjacent the interior edge to the hollow, and heat pipes in said bores extending into the cooling chamber formed by said hollow.

2. A furnace wall construction as in claim 1 wherein sealing rings are provided around said heat pipes adjacent to the inner ends of said bores to seal the bores around the heat pipes adjacent to the hollow cooling chamber.

3. A furnace wall construction as in claim 2 wherein said cooling plate is fabricated from copper.

4. A furnace wall construction as in claim 1 wherein the rearwardly facing edge is comprised of a back plate removable from the cooling plate by means of removable bolts.

* * * * *